US008686321B2

(12) United States Patent
Parachini et al.

(10) Patent No.: US 8,686,321 B2
(45) Date of Patent: Apr. 1, 2014

(54) METHOD FOR SUPPLYING POWER TO INDUCTION COOKING ZONES OF AN INDUCTION COOKING HOB HAVING A PLURALITY OF POWER CONVERTERS, AND INDUCTION COOKING HOB USING SUCH METHOD

(75) Inventors: Davide Parachini, Cassano Magnago (IT); Francesco Del Bello, Rome (IT); Andrea De Angelis, Varano Borghi (IT); Jurij Paderno, Varedo (IT)

(73) Assignee: Whirlpool Corporation, Benton Harbor, MI (US)

( * ) Notice: Subject to any disclaimer, the term of this patent is extended or adjusted under 35 U.S.C. 154(b) by 195 days.

(21) Appl. No.: 12/861,878

(22) Filed: Aug. 24, 2010

(65) Prior Publication Data

US 2011/0079591 A1 Apr. 7, 2011

(30) Foreign Application Priority Data

Oct. 5, 2009 (EP) ..... 09172198

(51) Int. Cl.
*H05B 6/04* (2006.01)
*H05B 6/12* (2006.01)

(52) U.S. Cl.
USPC ..... 219/620; 219/660

(58) Field of Classification Search
USPC ..... 219/660, 661, 620, 663; 700/300
See application file for complete search history.

(56) References Cited

U.S. PATENT DOCUMENTS

| | | | | |
|---|---|---|---|---|
| 6,528,770 | B1 * | 3/2003 | Akel et al. | 219/624 |
| 7,910,865 | B2 * | 3/2011 | Haag et al. | 219/620 |
| 2006/0207988 | A1 * | 9/2006 | Larson et al. | 219/501 |
| 2007/0108186 | A1 * | 5/2007 | Fisher et al. | 219/486 |
| 2009/0084777 | A1 * | 4/2009 | Oh et al. | 219/672 |
| 2009/0230123 | A1 * | 9/2009 | Egenter et al. | 219/660 |
| 2010/0282740 | A1 * | 11/2010 | Artigas Maestre et al. | 219/662 |

FOREIGN PATENT DOCUMENTS

| | | | |
|---|---|---|---|
| DE | 102004003126 | A1 | 8/2005 |
| EP | 1895814 | A1 | 3/2008 |
| EP | 1951003 | A1 | 7/2008 |
| WO | 2005043737 | A2 | 5/2005 |
| WO | 2006117182 | A1 | 11/2006 |
| WO | 2009090152 | A1 | 7/2009 |

OTHER PUBLICATIONS

Translation of Klingner et al (DE 102004003126), (Aug. 4, 2005) 2 pages.*
European Patent Application No. 09172198.5 filed Oct. 5, 2009, Applicant: Whirlpool, Search Report Mail Date: Mar. 18, 2010.

* cited by examiner

*Primary Examiner* — Caridad Everhart

(57) ABSTRACT

A method for supplying power to induction cooking zones of an induction cooking hob with a plurality of power converters, each feeding an induction heating element, comprises feeding all the induction heating elements according to a predetermined and repetitive driving sequence in order to keep a predetermined delivered power to the induction heating elements according to user input.

12 Claims, 12 Drawing Sheets

$$\sum_i T_i = T \qquad \overline{Px} = \sum_i Px_i * \frac{T_i}{T}$$

METHOD FOR SUPPLYING POWER TO INDUCTION COOKING ZONES OF AN INDUCTION COOKING HOB HAVING A PLURALITY OF POWER CONVERTERS, AND INDUCTION COOKING HOB USING SUCH METHOD

BACKGROUND OF THE INVENTION

1. Field of the Invention

The present invention relates to a method for supplying power to induction cooking zones of an induction cooking hob with power converters, each of such power converters feeding an inductor.

2. Description of the Related Art

An induction cooking system comprises two main components; an AC/AC power converter (usually of the resonant type) that transforms a mains line voltage (ex. 230V, 50 Hz in many EU countries) into a high frequency AC voltage (usually in the 20-50 kHz range) and an inductor that, when a cooking vessel is placed on it, induces a high frequency magnetic field into the cooking vessel bottom that, by Joule effect caused by induced eddy current, heats up. It is desirable that the power delivered to the cooking vessel can be adjusted, according to the recipe chosen by the user, from a minimum to a maximum power, and such feature can be obtained by adjusting some working parameters of the AC/AC converter, such as the operating frequency of the output signal and/or the operating voltage of the output signal.

When an induction cooking system comprises more than one inductor, some electric or magnetic coupling may exist between the AC/AC converters and/or the inductors, or a limitation on the sum of the power delivered by the inductors may exist because of limited rating of the mains line power. The electric or magnetic couplings result in generation of audible noise when two coupled converters or inductors are operated at different frequencies (whose difference lies in the audible range) and cause excessive disturbances on the mains line that can exceed the standard compliance limitation. Furthermore the mains line rating limitation on the maximum available power requires that a common control prevents the total power delivered by the converters connected to a mains line from exceeding the prescribed limit.

To avoid audible disturbances when operating two coupled induction cooking systems (each having AC/AC inverter plus inductor) both systems may be operated at the same frequency or at frequencies whose difference lies outside the audible range. The operation at different frequencies can result in increased mains line disturbance level, so that it is preferable to avoid this condition. In order to allow the required flexibility in the power setting and adjustment, the operating voltage of the AC/AC converter should be used as control parameter.

Changing the output voltage is difficult to implement cost effectively for resonant converters normally used in induction cooking systems.

For half bridge series resonant converters, among the possible ways to change and therefore adjust the output voltage, is to operate on the power switches activation duty cycle. Deviating from the standard operating condition of the switches control (duty cycle=50%) can result in loss of soft switching working condition on the power switches, and severe switching loss increase can lead to overheating and failure of the devices. The method of changing the output voltage should be used only for "small" changes (approximately for a power regulation in the range 2:1, which allows to keep the soft switching condition) but the required flexibility for commercial induction cooking systems is to have a power ratio as high as 100:1. Other methods of changing the output voltage (for example using silicon-controlled rectifier SCR on the rectifying bridge to reduce the mains voltage rms value, or introducing a Boost or Buck regulator ahead of the half bridge circuit), require additional costs that are not economically attractive for the market. A technical solution of this kind is disclosed by EP-A-1895814.

Audible noise generation can be avoided as described in WO 2005/043737 where the operation of two coupled induction systems is allowed when the frequency difference lies outside the audible frequency range (~20 Hz-20 kHz). By combining this feature with the voltage change, a higher flexibility in the operation can be obtained, but higher disturbance level is generated on the mains line.

The power can be limited with an ON/OFF operation of an induction system. For example, to get 500 W out of a converter, the latter can be operated at 1000 W for half of the operating time. This method becomes effective when the control cycle time is much smaller than the thermal time constant of the cooking vessel, so that the average power is delivered to the food being cooked without the user perceiving the power modulation.

This method described above can be used alone to control the delivered power only with special care, since it can involve big power steps, and consequently high flicker values that can cause the product to fail the standard IEC relevant test. Therefore, the power step must be kept low or the cycle time must be made high enough to limit the flicker value, but a limit exists such that the cycle time should be much smaller than the cooking vessel thermal time constant, otherwise the customer will strongly perceive the ON/OFF modulation in the cooking process.

A similar control method for controlling two inductors is described in EP-A-1951003, and it solves the problem for a cooking system made of two inductors coupled by the mains, as shown in the attached FIG. 2. The solution disclosed solves only one of the coupling problems at a time, but it is not able to solve the whole problem of several power converters and inductors, because it does not create enough freedom in the system to match the user setting and the system constraints.

SUMMARY OF THE INVENTION

An object of the present disclosure is to provide a method of delivering the required power to a plurality of interconnected induction cooking systems, some of them being coupled because of shared mains line (FIG. 2) or shared inductors/cooking vessel (FIG. 3), that maximizes the efficiency and limits the noise and flicker emission.

The method according to the disclosure relies on the basic principle that the required power is delivered to each cooking vessel on a time average (control cycle). During the control cycle, which can be repeated on and on for an infinite time, the constraints for eliminating noise, flicker and power rating limitation are fulfilled each time, while the power set by the user is delivered over an average during the control cycle.

The method according to the disclosure allows flexibility in power delivery, without losing efficiency in the system. Moreover, the method according to the disclosure extends the control strategy to more than two coupled induction cooking systems with different types of couplings, rather than the limited degree of flexibility of constraints that is present in systems as depicted in FIG. 5.

BRIEF DESCRIPTION OF THE DRAWINGS

Further advantages and features according to the present invention will be clear form the following detailed description, with reference to the attached drawings in which:

FIG. 8*a* shows the power delivered on each of the four inductors during the cycle time, and FIG. 8*b* shows the power absorbed by each mains line, according to the same control sequence;

DETAILED DESCRIPTION OF PREFERRED EMBODIMENTS

Figure 1A:
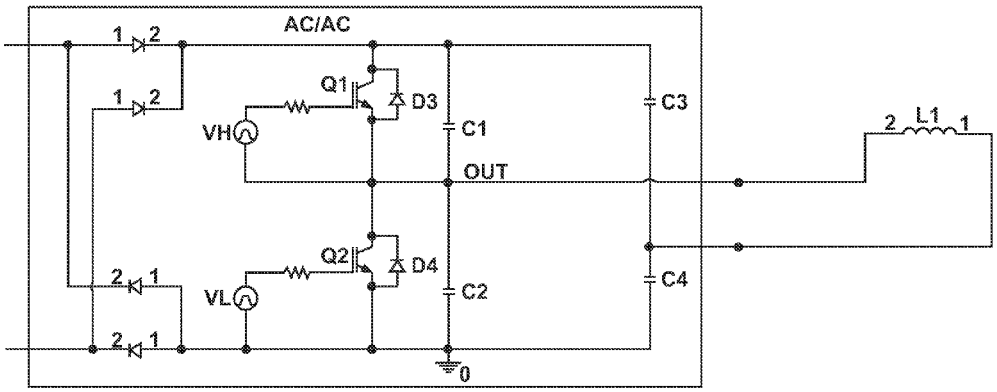
FIG. 1*a* shows a circuit for driving an inductor and includes a power converter.
Figure 1B:
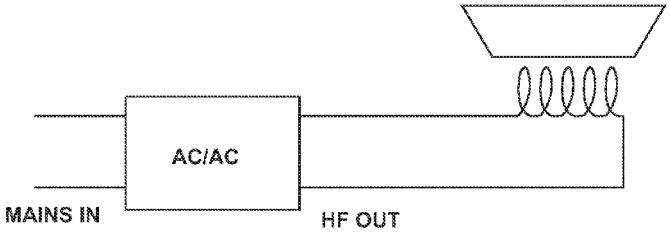
FIG. 1*b* is a schematical view on an induction cooking system using the power converter of FIG. 1*a;*
Figure 2:
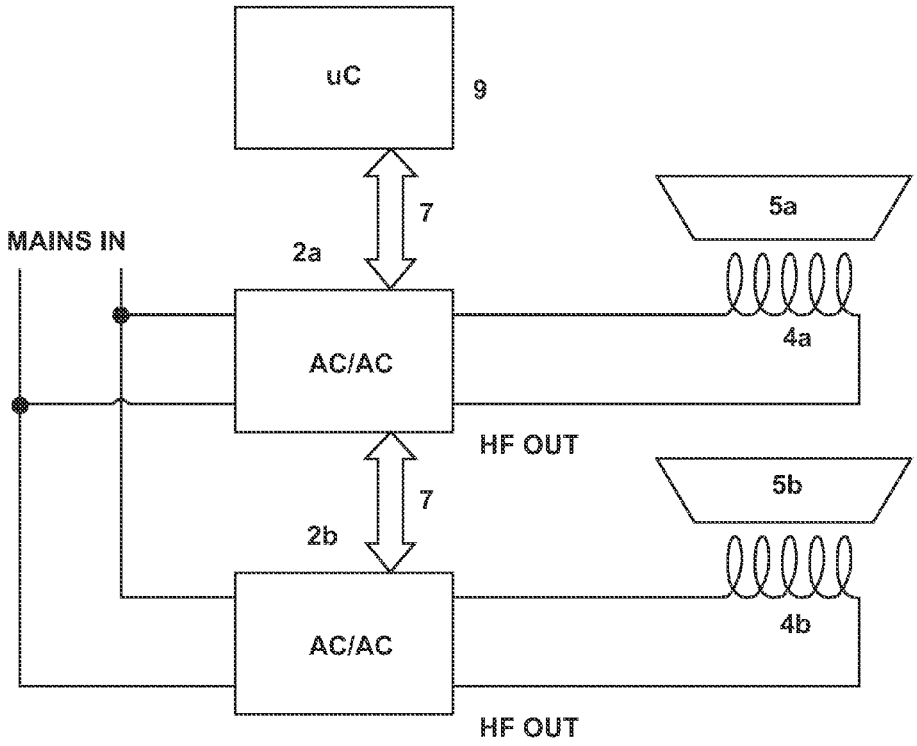
FIG. 2 is a schematical view similar to FIG. 1*b* showing two power converters driven by a central process unit and sharing the same mains line.
Figure 3:
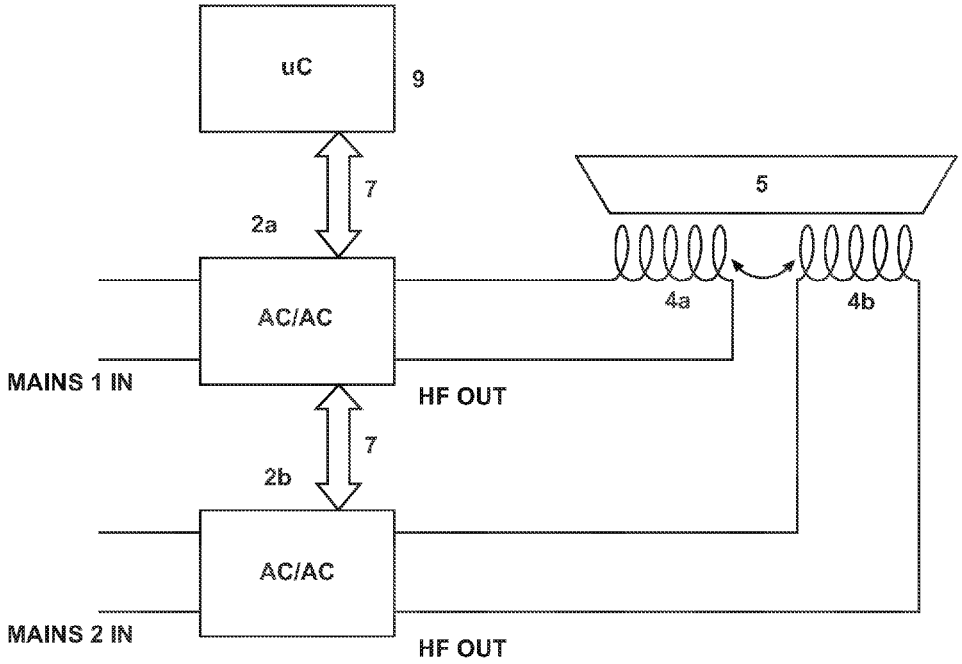
FIG. 3 is similar to FIG. 2 in which two power converters are fed through different mains lines and drive two magnetically coupled inductors which heat the same pot.
Figure 4:
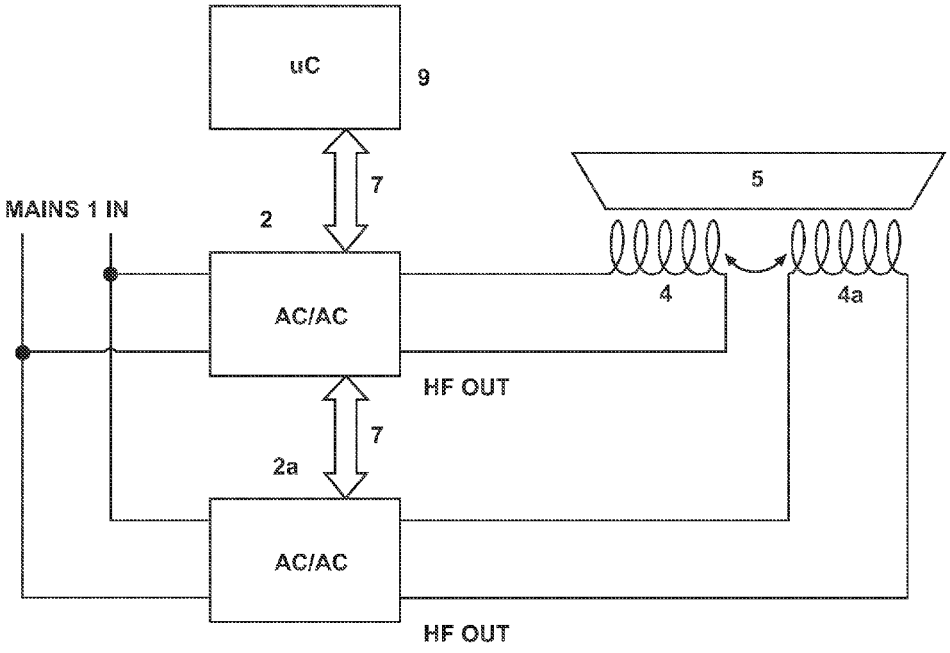
FIG. 4 is similar to FIG. 3 in which the two power converters share the same mains line.
Figure 5:
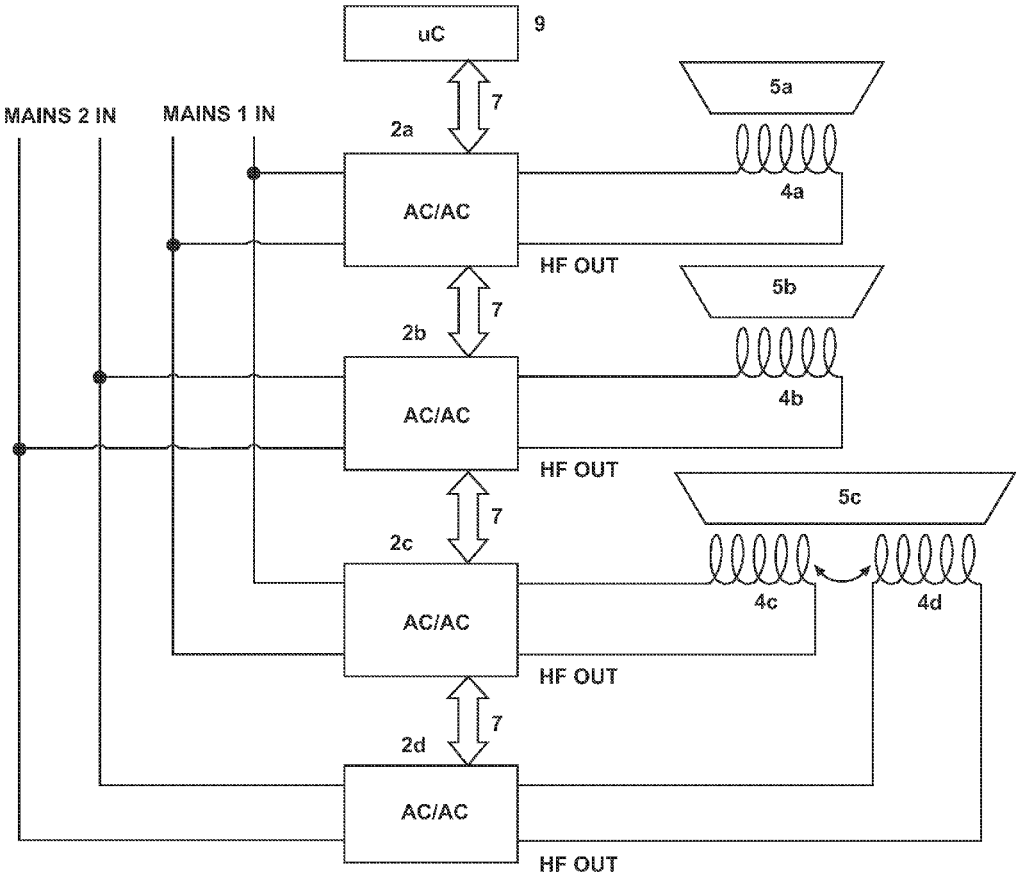
FIG. 5 is a schematical view of an induction cooking hob having a plurality of power converters and inductors, some converters sharing the mains lines and some inductors sharing the same pot.

With reference to the drawings, in FIG. 5, is shown an induction cooking system made of four AC/AC converters 2*a*, 2*b*, 2*c* and 2*d* of the same type of the single converter shown in FIGS. 1*a* and 1*b*. Two of such converters, particularly 2*a* and 2*c*, are coupled by the mains line (indicated in the drawings with the reference MAINS 1 IN). The induction cooking system comprises four inductors or inductive heating elements 4*a*, 4*b*, 4*c* and 4*d*, two of which, particularly 4*c* and 4*d*, are magnetically coupled and share the same cooking vessel 5*c*.

When inductors 4*a* and 4*c* work together through AC/AC converters 2*a* and 2*c*, such converters must be operated at the same switching frequency and the total power shall be limited by the mains and AC/AC converter rating, i.e. usually without exceeding 16 A on each mains power line. When inductors 4*b* and 4*d* work together through AC/AC converters 2*b* and 2*d*, converters must be operated at the same switching frequency and the total power shall be limited by the mains and AC/AC converter rating. When inductors 4*c* and 4*d* works together through AC/AC converters 2*c* and 2*d*, converters must be operated at the same switching frequency and the total power shall be limited by the mains and AC/AC converter rating.

If the user of the system described in FIG. 5 requests a certain power setting that includes all inductors 4*a*, 4*b*, 4*c* and 4*d*, the known methods, and particularly the method described in EP-A-1951003, applied to couples of converters, would not give the required performances in terms of power delivery, acoustic noise or flicker emission. The control cycle that satisfies the system requirements and the user requirements is made, according to the present disclosure, by a finite sequence of elementary actuation steps, selected among all those possible for the specific system configuration matching the system constraints. Table 1 below shows the possible system configurations:

| | Converter status | | | |
|---|---|---|---|---|
| Configuration | 2a | 2b | 2c | 2d |
| 1 | OFF | OFF | OFF | OFF |
| 2 | OFF | OFF | OFF | ON |
| 3 | OFF | OFF | ON | OFF |
| 4 | OFF | OFF | ON | ON |
| 5 | OFF | ON | OFF | OFF |
| 6 | OFF | ON | OFF | ON |
| 7 | OFF | ON | ON | OFF |
| 8 | OFF | ON | ON | ON |
| 9 | ON | OFF | OFF | OFF |
| 10 | ON | OFF | OFF | ON |
| 11 | ON | OFF | ON | OFF |
| 12 | ON | OFF | ON | ON |
| 13 | ON | ON | OFF | OFF |
| 14 | ON | ON | OFF | ON |
| 15 | ON | ON | ON | OFF |
| 16 | ON | ON | ON | ON |

The first column shows the reference number of a specific system configuration and the other four columns show the ON or OFF condition of each of the power converters. For an induction cooking system made of N AC/AC converters, each feeding an inductor, $2^N$ is the number of available configurations of activation.

Figure 6:
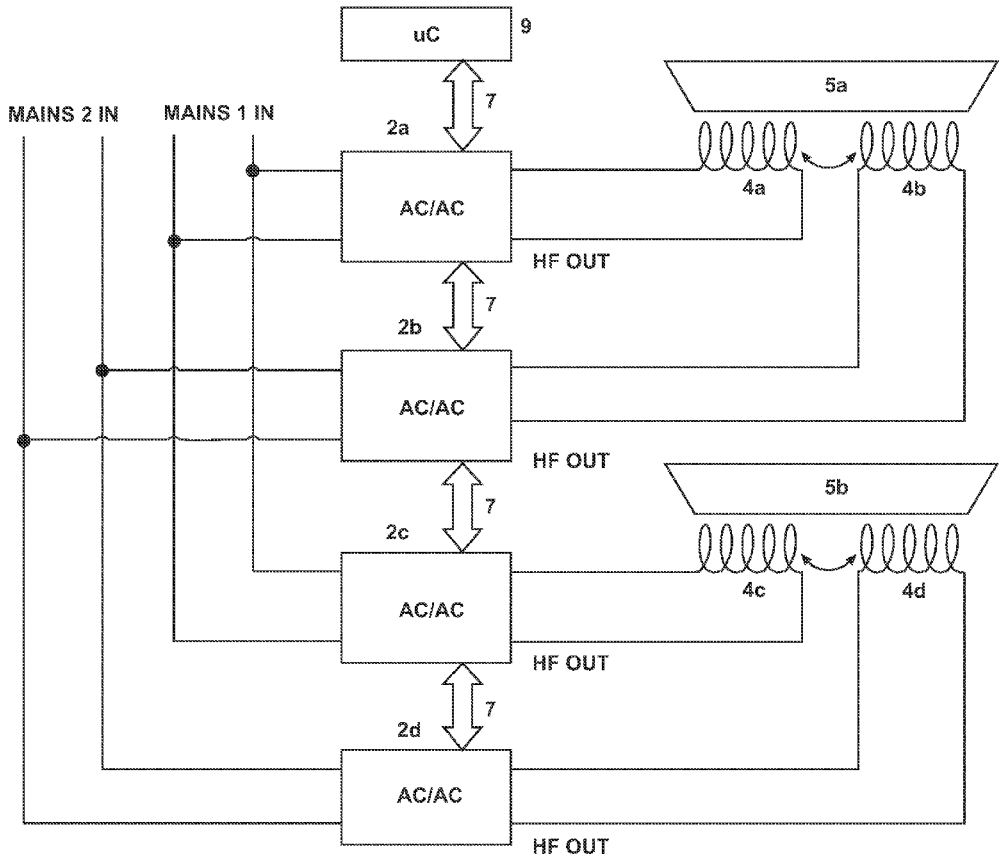
FIG. 6 is similar to FIG. 5 in which each heating zone has two shared inductors.
Figure 8A:
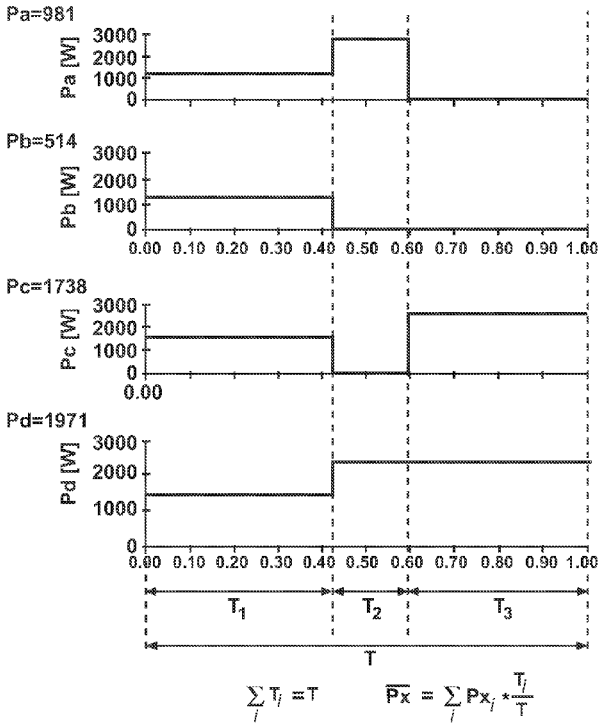
FIGS. 8*a* and 8*b* show a typical pattern of how the power is delivered from power converters in a certain time frame and according to the user requirements, specifically
Figure 8B:
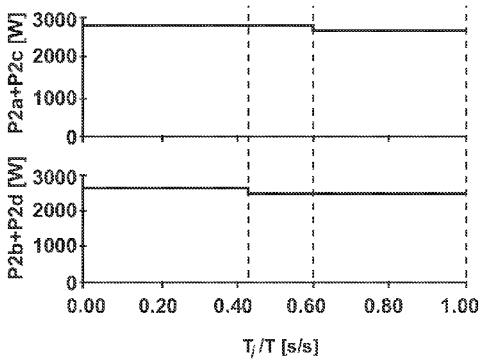
Figure 9A:
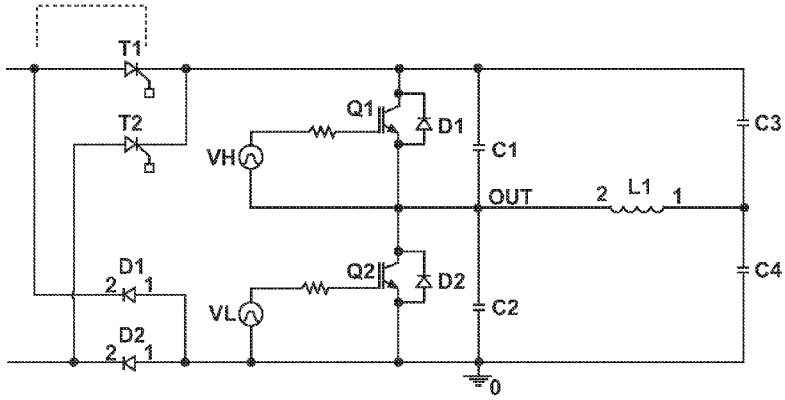
FIGS. 9*a* and 9*b* shows known methods to achieve power regulation using output voltage modulation based on SCR devices on the bridge rectifier (in FIG. 9*a* elements T1,T2) and Buck conversion (in FIG. 9*b* elements Q3, L2, D3)
Figure 9B:
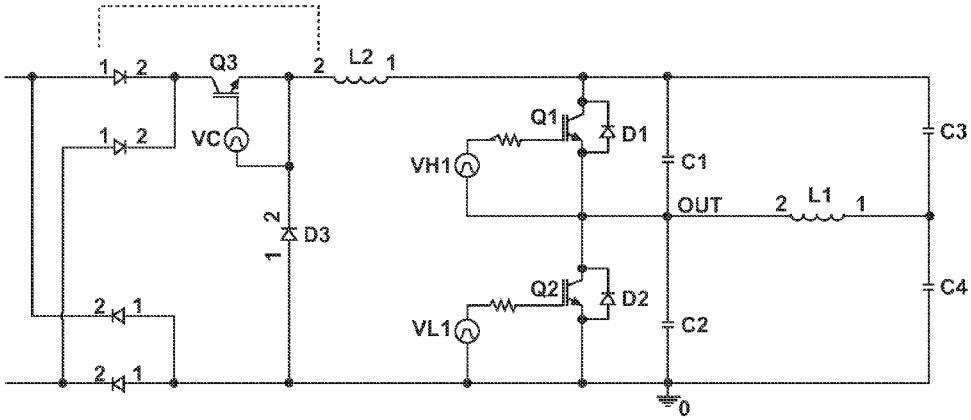

FIG. 8*a* shows an example of an optimal sequence for driving all the inductors according to the predetermined input from the user (in this case all the four inductors are in an average switched-on configuration) in which the driving sequence has a duration of 1 second. The duration of the driving sequence may be between 1 second and 5 seconds. FIG. 8*b*, derived from FIG. 8*a*, shows the power sequence of two couples of inductors 2*a*+2*c* and 2*b*+2*d* respectively of FIGS. 5 and 6, and shows how small the power variation is along the control cycle and consequently the flicker induced on the mains lines is also small.

The cycle must not only match the user requirements, but also the requirements set by the following:

Step 1 (configuration 16)

T1: f2*a*=f2*c*=f2*b*=f2*d*

P1*a*+P1*c*<Pmains1max;

P1*b*+P1*d*<Pmains2max

Step 2 (configuration 10)

T2: f2*a*=f2*d*

P1*a*<Pmains1max;

P1*d*<Pmains2max

Step 3 (configuration 4)

T3: f2*c*=f2*d*

P1*a*+P1*c*<Pmains1max;

P1*b*+P1*d*<Pmains2max

Figure 7:
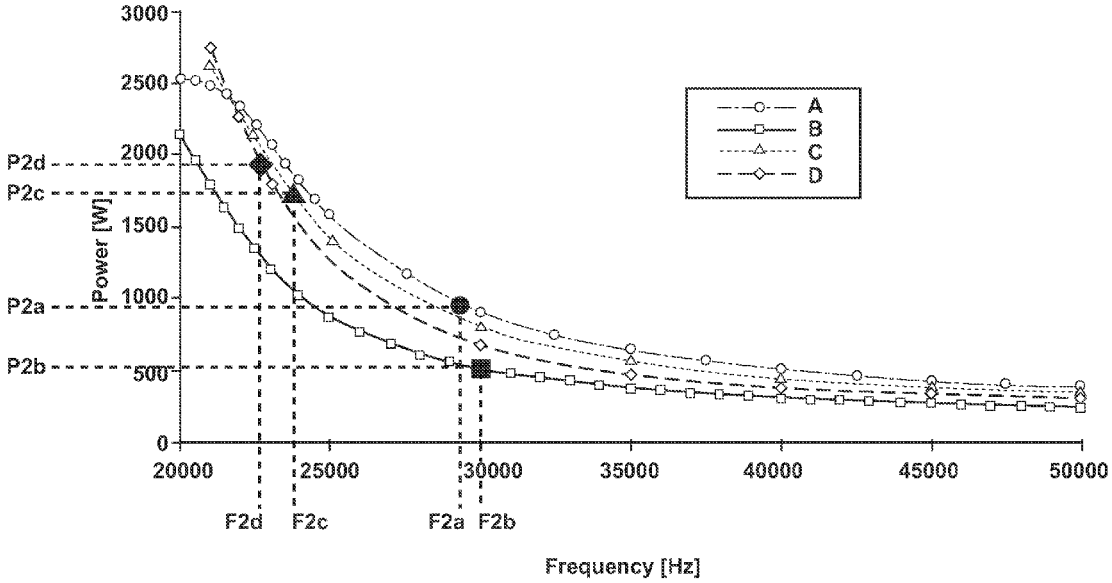
FIG. 7 shows the power vs. frequency relationship of the four power converters of FIGS. 5 and 6.

To calculate the activation sequence (FIGS. 8*a* and 8*b*), one or more microcontrollers 9 installed in the system has to first measure the power versus frequency characteristic of each AC/AC converter in the system in which the power activation is required by the user (like those depicted in FIG. 7). Then using this data and the user input requirements, the microcontroller 9 looks for the right activation sequence that matches the system constraints (shown in the above formula) and user constraints. The microprocessor uses the most recent mathematical optimization techniques, or advanced genetic algorithms, or an iterative process in which the best actuation sequence is searched among all the possible sequences that fit the user and system requirements.

The microcontroller 9 may calculate the activation sequence using an iterative search process as follows:

A: After the user has input the power setting, the microcontroller 9 actuates the power converters in order to sequentially acquire each converter (among those requiring non-zero power by the user) power curve, as shown in FIG. 7. The inductors having a magnetic coupling may also acquire a power curve by actuating the two coupled inductors at the same time;

B: Consider a configuration from the $2^N$ possible (see Table 1 above for example) and that has at least one converter output required by the user switched ON;

C: Search the frequency/frequencies of the first step of the activation sequence that correspond to a target power absorbed by each mains line equal at least to the total average power required by the user on said mains line. If at the end of the search process the power is less than that required to fulfil the user power requests, the target power can be incremented in finite steps within the mains limit;

D: Calculate the time fraction over the cycle time it takes for at least a first output to fulfil its user requirements with the selected frequency. After completion of this step this output will no longer be activated;

E: Calculate the residual energy requirement for the remaining outputs in the remaining cycle time and repeat step B, excluding from the user requirements the one already fulfilled. When the calculated sequence does not fit in the control cycle time, a new starting configuration shall be selected in step B.

The process stops when either all user requests are fulfilled or when there are no more configurations to be considered (in such case the solution that best fit user requirements will be selected).

The above procedure may result in multiple solutions changing the starting point (the actuation configuration selected for the initial step). In instances where more than one solution is found, the one exhibiting the lowest mains power change during the cycle is selected in such a way to reach the lowest flicker solution.

Figure 10:
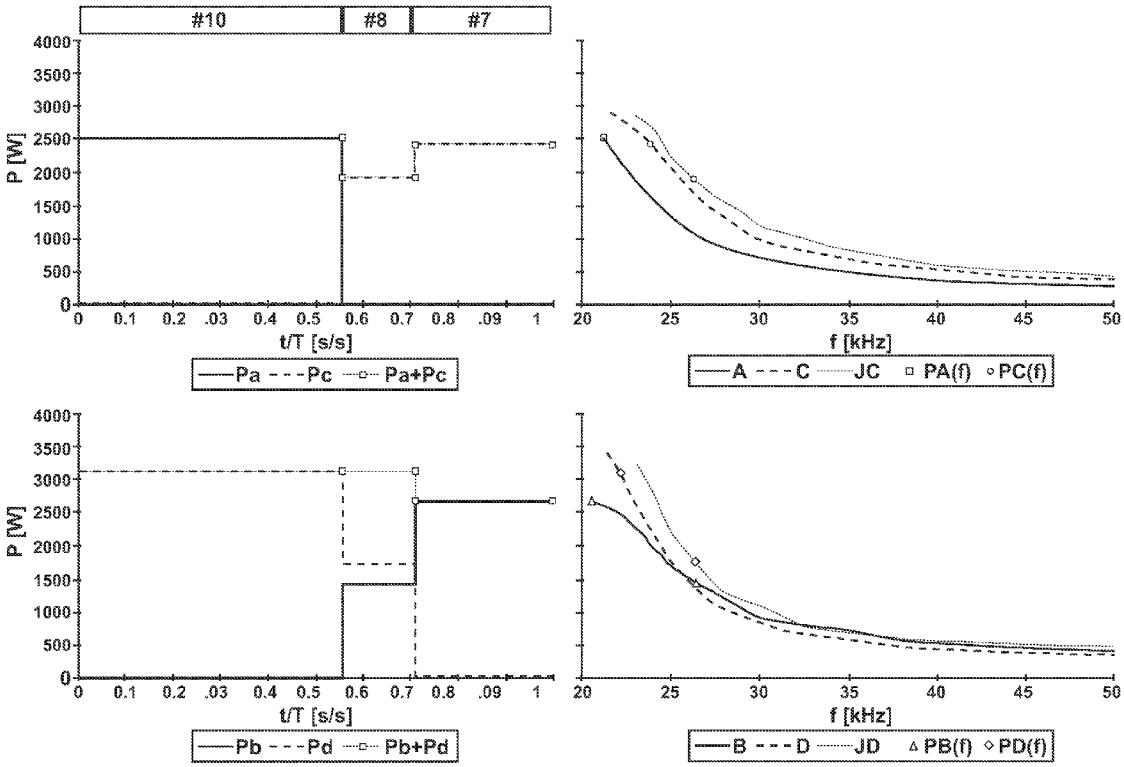
FIGS. 10, 11 and 12 depict examples of control cycles.

As an example of the above mentioned procedure, consider the following situation, applicable to a system like the one depicted in FIG. 5 with power curves depicted in FIG. 10 (right side):

User power settings:

| Converter | Power |
|---|---|
| 2a | 1400 W |
| 2b | 1000 W |
| 2c | 1000 W |
| 2d | 2000 W |

Consider configuration 10 from previous table (it has two of the four required output enabled). Since there is not interaction both between mains and inductors on converters 2*a* and 2*d*, the switching frequency can be different in the two converters.

The two switching frequencies can be found using power curves shown on the right side of FIG. 10 wherein the starting power setting is:

Pmains1=P2*a*+P2*c*=2520 W;

Pmains2=P2*b*+P2*d*=3130 W;

F2*a*_1=21250 Hz;

F2*d*_1=22100 Hz

With this power setting, the time needed to fulfil at least one user setting can be calculated by dividing the required power by the actuated power, the division resulting in 0.557 for 2*a* and 0.639 for 2*d*, so the configuration 10 will last for the smaller one i.e. 55.7% of the cycle time delivering the following energy (the Joule unit is for convenience only and it will be true with a cycle time of 1 second):

E2*a*_1=1400 J;

E2*b*_1=0 J;

E2*c*_1=0 J;

E2*d*_1=1750J

All the user required energy has been delivered to output 2*a*, and 250 J are required on output 2*d* in the remaining 44.3% of the cycle time.

When configuration 8 is selected from Table 1, output 2*b*, 2*c* and 2*d* are coupled, and their activation cannot be calculated separately. Using curves in FIG. 10 and the mains power setting so that the mains power exhibit the smallest change, the switching frequency that satisfies at least one of the mains power setting is selected:

P2*a*_2=0;

P2*b*_2=1420 W;

P2*c*_2=1900 W;

P2*d*_2=1720 W

As shown in FIG. 10, to get these powers at output 2*b*, 2*c* and 2*d*, the switching frequency has to be set to (since output 2*c* and 2*d* are coupled, the power curve to be used in this case has to be acquired activating together the two outputs, resulting in the JC and JD curves in FIG. 10):

F2*b*_2=F2*d*_2=26400 Hz;

F2*c*_2=26400 Hz

The above configuration may last for 15% of the cycle time, at the end of which the output 2*d* will have completely fulfilled the user requirement.

When configuration 7 is selected from Table 1, output 2*b* and 2*c* are not coupled, therefore their activation can be calculated separately. Using curves in FIG. 10 and the mains power setting such that the mains power exhibit the smallest change, the switching frequency that satisfies the remaining energy requirements (since they are independent) is selected:

P2*a*_3=0;

P2*b*_3=2680 W;

P2*c*_3=2430 W;

P2*d*_3=0 W

As shown in FIG. 10, in order to get these powers at output 2*b*, 2*c* the switching frequency has to be set to:

F2*b*_3=20500 Hz;

F2*c*_3=23900 Hz

Configuration 7 will last for the remaining 29.3% of the cycle time. By calculating the average power on each output as specified in FIG. 8*a*, the above user settings are satisfied with a sequence like the one depicted in FIG. 10.

Figure 11:
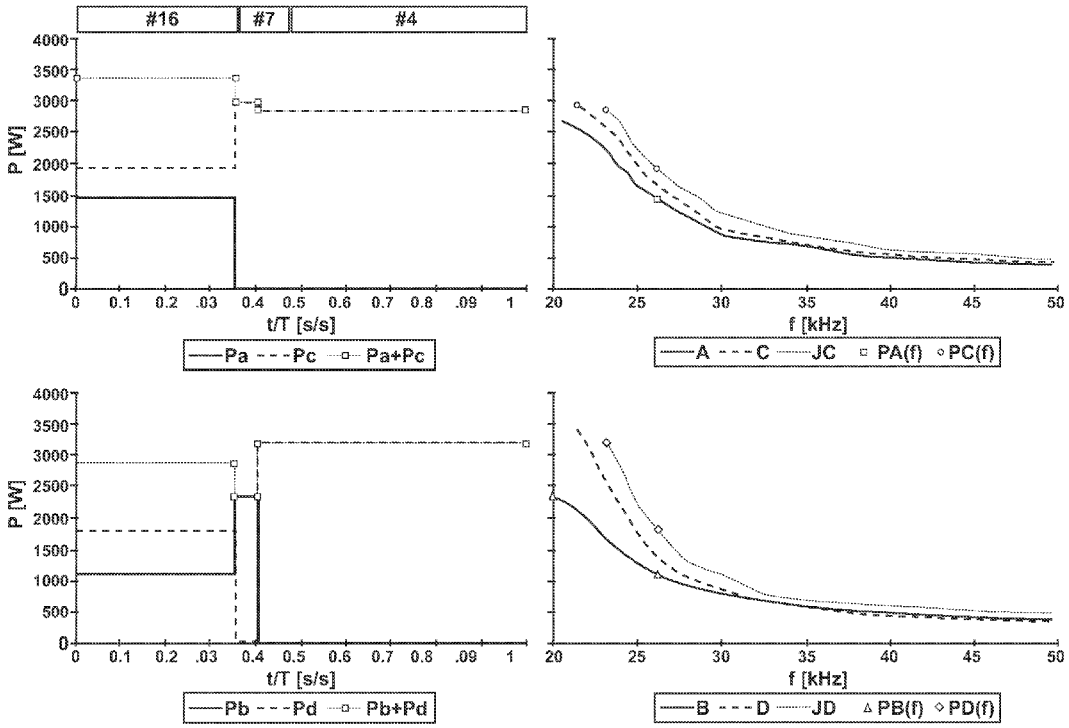
Figure 12:
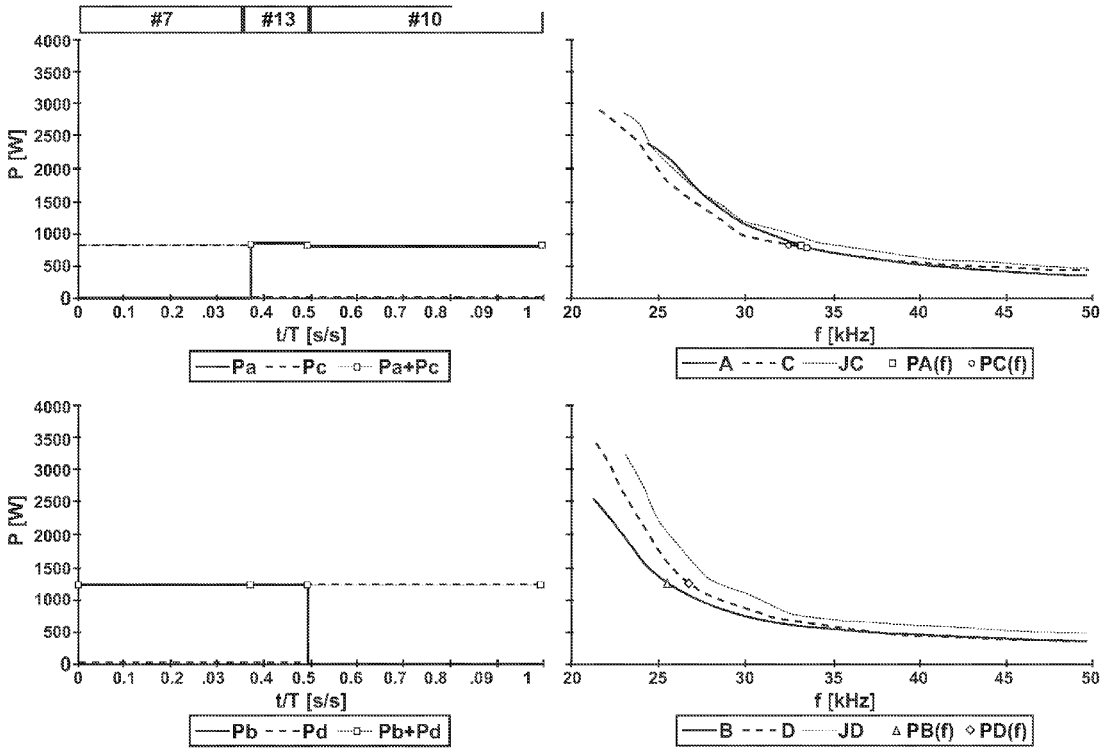

Other examples of control sequences are depicted in FIGS. 11 and 12 and show that the control sequences vary depending on the power curves and user requests.

FIG. 11 shows the control cycle for the following user request and achieved through a sequence of configurations 16, 7, and 4:

P2*a*=500 W;

P2*b*=500 W;

P2*c*=2500 W;

P2*d*=2500 W

FIG. 12 shows the control cycle for the following user request and achieved through a sequence of configurations 7, 13, and 10:

P2*a*=500 W;

P2*b*=600 W;

P2$c$=300 W;

P2$d$=600 W

While this disclosure has been specifically described in connection with certain specific embodiments thereof, it is understood that this is by way of illustration and not of limitation, Reasonable variation and modification are possible within the scope of the foregoing disclosure and drawings without departing from the spirit of the invention which is defined in the appended claims.

What is claimed is:

1. A method for supplying power from one or more mains lines to induction heating zones of an induction cooking hob with a plurality of power converters each feeding electrical power to an associated induction heating element, said method comprising:

obtaining a user input representing a selected average power level setting for each power converter and associated induction heating element; and feeding the induction heating elements according to a predetermined and repetitive driving sequence configured on a control unit in order to deliver power to each induction heating element according to the selected average power level, wherein the driving sequence is an optimum sequence as compared to a plurality of possible sequences stored on the control unit.

2. The method according to claim 1, wherein the repetitive driving sequence has a cycle time duration between 1 second and 5 seconds.

3. The method according to claim 1, further comprising feeding two of the plurality of power converters from a single mains line of the one or more mains lines and preventing the driving sequence from drawing more than a predetermined amount of current from the single mains line.

4. The method according to claim 1 wherein the optimal repetitive driving sequence is selected based on having at least one of the lowest mains power change during a cycle, lowest acoustic noise and lowest flicker emission.

5. The method according to claim 1, further comprising:

determining electrical constraints of the induction cooking hob;

assessing a power versus frequency characteristic of each power converter;

determining an operating frequency of each converter according to the selected power level setting for each induction heating element; and determining an optimal repetitive driving sequence based on the selected average power level for each induction heating element and the electrical constraints of the induction cooking hob.

6. The method according to claim 5, wherein determining the optimal repetitive driving sequence further comprises:

choosing a configuration of induction heating elements from $2^N$ possible configurations, where N is the number of selected induction heating elements and the configuration indicates which selected power converters are to be powered;

actuating the selected power converters to acquire power curves of the selected power converters;

determining a frequency for each selected power converter that corresponds to a target power absorbed by each mains line;

calculating a time fraction required per cycle time duration that the selected power converters have to be activated to provide the selected average power level for at least one selected power converter;

calculating a residual energy requirement for any induction heating elements that are not powered to their selected average power level during the time fraction;

choosing another configuration of induction elements from the $2^N$ possible configurations and the other configuration indicates selected power converters are to be powered;

actuating the selected power converters to acquire power curves of the selected power converters of the other configuration;

determining a frequency for each selected power converter of the other configuration that corresponds to another target power absorbed by each mains line; and calculating a time fraction required per cycle time duration that the selected power converters of the other configuration have to be activated to provide the residual level for at least one selected power converter of the other configuration.

7. An induction cooking hob comprising:

a plurality of induction heating elements;

a user input for selecting an average power level for each of the plurality of induction heating elements;

a plurality of power converters each feeding an associated one of the plurality of induction heating elements; and a control unit directing the plurality of power converters to feed power to the plurality of induction heating elements according to a predetermined and repetitive driving sequence to deliver power to each induction heating element according to the selected average power level set through the user input, wherein the driving sequence is an optimum sequence stored on the control unit and is compared to and selected from a plurality of possible sequences stored on the control unit based on the user input and a system constraint.

8. The induction cooking hob according to claim 7, wherein the control unit is configured to:

determine electrical constraints of the induction cooking hob;

assess a power versus frequency characteristic of each power converter;

determine an operating frequency of each converter according to the selected average power level for each induction heating element; and determine the optimal repetitive driving sequence based on the selected average power level for each induction heating element and the electrical constraints of the induction cooking hob as compared to the plurality of possible sequences stored on the control unit.

9. The induction cooking hob according to claim 7, wherein the repetitive driving sequence has a cycle time duration between 1 second and 5 seconds.

10. The induction cooking hob according to claim 7, where two of the plurality of power converters are fed by a single mains line and the control unit prevents the driving sequence from drawing more than a predetermined amount of current from the single mains line.

11. The induction cooking hob according to claim 7, wherein the predetermined and repetitive driving sequence includes a cycle time duration divided into time fractions, each time fraction has an associated configuration of induction heating elements from $2^N$ possible configurations, where N is the number of selected induction heating elements and the configuration indicates which selected power converters are to be powered, and a frequency for each selected power converter that corresponds to a target power absorbed by each mains line whereby the selected average power level is sent to the induction heating elements and acoustic noise and flicker emission are reduced.

12. A method of controlling an induction cooking hob, comprising:

inputting a power setting by a user;

measuring a power input based on the power setting versus a frequency characteristic of at least two convertors with a microcontroller;

searching a data set stored in a microprocessor in the microcontroller; and determining a preferred activation sequence as compared to the data stored and the power input, wherein the preferred activation sequence matches a system constraint and a user constraint, the preferred activation sequence is the best activation sequence among a plurality of predetermined stored sequences as compared to the user and system requirements.

* * * * *